US008424231B2

(12) United States Patent
Sliwa

(10) Patent No.: US 8,424,231 B2
(45) Date of Patent: Apr. 23, 2013

(54) SYSTEMS AND METHODS FOR TRACKING CLOTHING USAGE

(75) Inventor: Nancy Ellen Sliwa, White Salmon, WA (US)

(73) Assignee: Nancy Ellen Sliwa, White Salmon, WA (US)

( * ) Notice: Subject to any disclaimer, the term of this patent is extended or adjusted under 35 U.S.C. 154(b) by 180 days.

(21) Appl. No.: 12/825,282

(22) Filed: Jun. 28, 2010

(65) Prior Publication Data

US 2011/0010970 A1 Jan. 20, 2011

Related U.S. Application Data

(60) Provisional application No. 61/226,566, filed on Jul. 17, 2009.

(51) Int. Cl.

| | |
|---|---|
| ***G09F 3/16*** | (2006.01) |
| ***G09F 3/18*** | (2006.01) |
| ***A41B 9/04*** | (2006.01) |

(52) U.S. Cl.
USPC ..... 40/666; 40/661.04; 40/662; 2/406

(58) Field of Classification Search ..... 40/666, 40/661.04, 662; 2/406
See application file for complete search history.

(56) References Cited

U.S. PATENT DOCUMENTS

| | | | | |
|---|---|---|---|---|
| D224,657 | S | | 8/1972 | Fisher |
| D243,815 | S | | 3/1977 | Henry |
| D244,661 | S | | 6/1977 | Henry |
| D244,737 | S | | 6/1977 | Henry |
| D245,749 | S | | 9/1977 | Henry |
| 4,096,655 | A | * | 6/1978 | Ullman, Jr. ..... 40/666 |
| D285,463 | S | | 9/1986 | Davis |
| D304,218 | S | | 10/1989 | Klitsner |
| 4,886,010 | A | | 12/1989 | Stutzman |
| 5,499,466 | A | | 3/1996 | House |
| 6,035,570 | A | | 3/2000 | Maglio |
| D423,799 | S | | 5/2000 | Sorensen et al. |
| D445,835 | S | | 7/2001 | Znutas |
| D446,819 | S | | 8/2001 | Caloia et al. |
| 6,572,429 | B2 | | 6/2003 | Cheung |

(Continued)

FOREIGN PATENT DOCUMENTS

WO WO-2009058178 A1 5/2009

OTHER PUBLICATIONS

U.S. Appl. No. 29/364,795, filed Jun. 28, 2010, Sliwa.

*Primary Examiner* — Joanne Silbermann
*Assistant Examiner* — Syed A Islam
(74) *Attorney, Agent, or Firm* — Perkins Coie LLP

(57) ABSTRACT

Systems and methods for tracking clothing usage are disclosed. A representative method in accordance with a particular embodiment includes selecting an item of clothing and, before or after the item of clothing is worn a first time, removably attaching a first tag to the item of clothing. The first tag has a first fixedly integrated identifier having a characteristic attribute with a first value. After the item of clothing is worn at least one time with the first tag, the first tag can be removed and a second tag is removably attached to the item of clothing, with the second tag having a second fixedly integrated identifier with a second value of the characteristic attribute that is different than the first value. After the item is worn at least one time with the second tag, the item of clothing is designated for cleaning, and the second tag is removed.

11 Claims, 3 Drawing Sheets

U.S. PATENT DOCUMENTS

| | | | | |
|---|---|---|---|---|
| 7,086,121 | B2 | 8/2006 | Lippincott | |
| 7,334,359 | B1 | 2/2008 | Palmer | |
| D571,439 | S | 6/2008 | Wellner et al. | |
| D572,985 | S | 7/2008 | Galeano et al. | |
| D614,350 | S * | 4/2010 | Tsai | D28/39 |
| 8,006,632 | B2 * | 8/2011 | Schlesinger | 112/141 |
| 2005/0034480 | A1 | 2/2005 | Martz | |
| 2006/0248629 | A1 | 11/2006 | Barkman et al. | |
| 2009/0038634 | A1 | 2/2009 | Pearson | |
| 2009/0047867 | A1 | 2/2009 | Morello | |
| 2009/0064919 | A1 * | 3/2009 | Greenwald | 116/201 |

* cited by examiner

SYSTEMS AND METHODS FOR TRACKING CLOTHING USAGE

CROSS-REFERENCE TO RELATED APPLICATION

The present application claims priority to U.S. Provisional Application No. 61/226,566, filed on Jul. 17, 2009, entitled SYSTEMS AND METHODS FOR TRACKING CLOTHING USAGE, and incorporated herein by reference.

TECHNICAL FIELD

The present disclosure is directed generally to systems and methods for tracking clothing usage, including systems and methods for using color-coded or otherwise coded removable tags for tracking the usage of bras and/or other delicate undergarments.

BACKGROUND

Delicate garments tend to be expensive and sensitive to overcleaning. For example, women's undergarments are particularly sensitive to damage during washing. In addition, it is often difficult for women to find undergarments that fit well and are comfortable. Because quality garments are difficult to find and expensive to purchase, women are reluctant to have such garments damaged by overcleaning. On the other hand, if the garments are not cleaned often enough, they can build up dirt, bacteria, and odor, which can reduce the performance and/or usability of the garment and can result in the garment needing to be replaced sooner than it otherwise would be.

Several systems have been developed to track or monitor the number of times an article of clothing has been worn. Such systems include manual or automated devices that are applied to the clothing directly or to the clothing hanger. Several simple devices typically require the user to enter information on a tag, or otherwise perform a variety of actions. More complex systems are, by nature, more expensive and accordingly not as readily accessible and affordable. Accordingly, there remains a need for cost-effective yet reliable systems for tracking garment usage.

DETAILED DESCRIPTION

Aspects of the present disclosure are directed generally to systems for tracking clothing usage. Specific details of certain embodiments of the disclosure are described below in the context of clips used for women's bras, to provide a thorough understanding of these embodiments. However, in other embodiments, the system can include tags or other elements different than the clips described below, and/or such elements can be used in the context of clothing other than women's bras. Several details describing systems or processes that are well-known and often associated with such systems and processes, but that may unnecessarily obscure certain aspects of the disclosure, are not set forth in the following description for purposes of brevity. Moreover, although the following disclosure sets forth several embodiments of different aspects of the invention, several other embodiments can have different configurations and/or different components than those described below. As such, the invention may have other embodiments with additional elements, or without several of the elements described below with reference to FIGS. 1-3.

In general terms, aspects of the following disclosure are directed to systems and methods that facilitate cleaning clothing frequently enough to prevent deterioration or other undesirable effects, yet not so frequently as to damage the clothing by unnecessary overcleaning. A method in accordance with a particular embodiment of the disclosure includes selecting an item of clothing, for example, a woman's bra. Before or after the item of clothing is worn for a first time, the method can include removably attaching a first tag or other element to the item of clothing. The first tag can have a first, fixedly integrated identifier having a characteristic attribute with a first value. For example, the first tag can have a first color that is integrally associated with the first tag. After the item of clothing is worn at least one time with the first tag, the first tag can be removed and a second tag can be removably attached to the item of clothing in its place. The second tag can have a second fixedly integrated identifier having a second value of the characteristic attribute that is different from the first value. For example, the color of the second tag can be different than the color of the first tag. After the item of clothing is worn at least one time with the second tag, the item of clothing can be designated for cleaning. The second tag can be removed, either before or after cleaning. After the item of clothing has been cleaned, the same first tag (or another first tag with the same characteristic attribute value) can be reattached to the item of clothing, and the cycle can be repeated. Further specific details of selected embodiments are described below.

Figure 1:
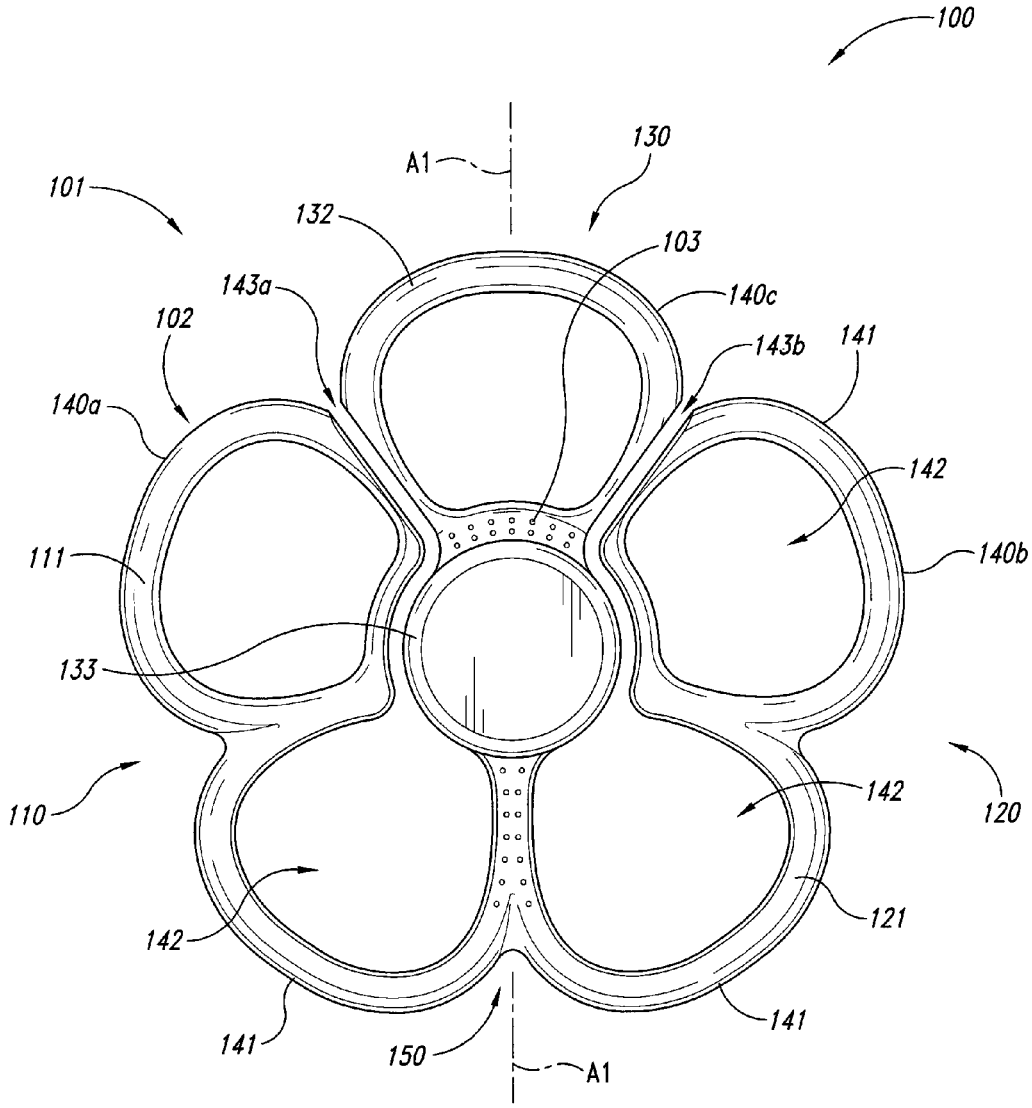
FIG. 1 is a partially schematic, front view of a tag that can form a part of an overall system for tracking garment usage in accordance with an embodiment of the disclosure.
Figure 2:
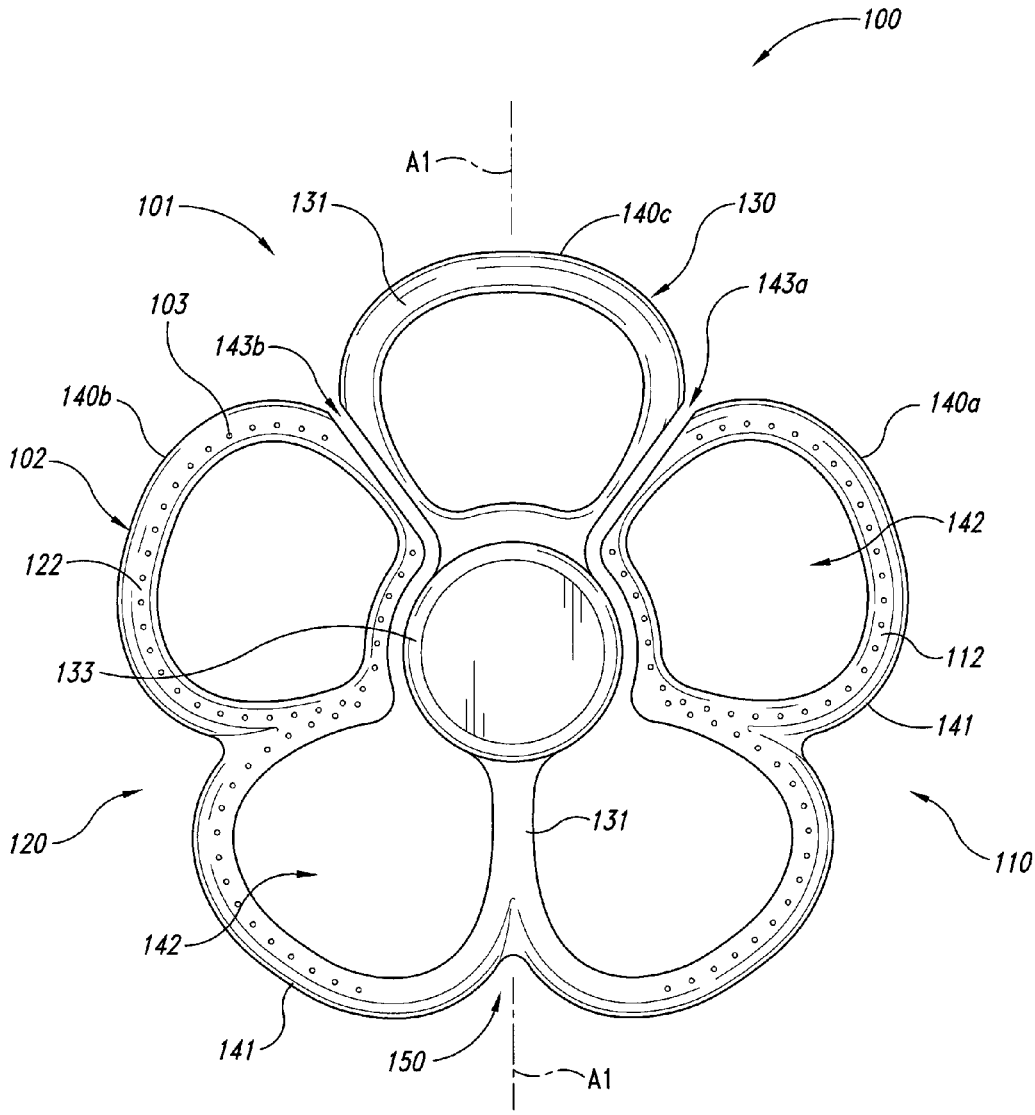
FIG. 2 is a partially schematic rear view of an embodiment of the tag shown in FIG. 1.

FIG. 1 is a partially schematic, front view of a representative tag 101 or other element, with multiple such elements forming an overall system 100. FIG. 2 is a rear view of the tag shown in FIG. 1. With reference now to FIGS. 1 and 2, the tag 101 can include a clip 102 suitable for being removably attached to an item of clothing. In a particular aspect of this embodiment, the clip 102 includes three portions, illustrated as a first portion 110, a second portion 120, and a third portion 130 positioned between the first portion 110 and a second portion 120. The three portions 110, 120, 130 can be attached to each other at an attachment region 150. The individual portions 110, 120, 130 can be movable relative to each other to provide a clip function, as described further below.

In a particular embodiment, each of the portions 110, 120, 130 can include at least one petal element 140, three of which are specifically identified as first, second, and third petal elements 140*a*, 140*b* and 140*c*, respectively. Each of the petal elements 140 can be arranged around a central region 133 carried by the third portion 130, and can include a rim 141 that surrounds or at least partially surrounds an open area 142. The petal elements 140 can be shaped like flower petals, and can serve functional and/or ornamental purposes, described further below. The clip 102 can include a total of five petal elements 140, as shown in FIGS. 1 and 2, or other numbers of petal elements in other embodiments.

In a particular embodiment shown in FIGS. 1 and 2, selected neighboring petal elements 140 are separated from each other by a slit. For example, the first petal element 140*a* can be separated from the third petal element 140*c* by a first slit 143*a*, and the second petal element 140*b* can be separated from the third petal element 140*c* by a second slit 143*b*. This arrangement allows the portions 110, 120, 130 of the clip 102 to be moved relative to each other.

Each of the portions 110, 120, and 130 can include outward surfaces that face away from the garment when the clip 102 is installed, and inward surfaces that face toward the garment when the clip 102 is installed. Accordingly, the first portion 110 can include an outward surface 111 and the second portion 120 can include an outward surface 121, both of which are visible in FIG. 1. The third portion 130 can include an inward surface 132 which is visible in FIG. 1, and an outward surface 131 which is visible in FIG. 2. The outward surface of the central portion 133 visible in FIG. 2 can also have a smoothly rounded bulge in the outward direction to help the user distinguish the outward surface from the inward surface of the central portion 133, which can be flattened. In other embodiments, either or both surfaces can have other shapes, e.g., concave or dished shapes. The central portion 133 can also include a colored feature or another feature (e.g., a rhinestone) that distinguishes one clip from another, as described further later. FIG. 2 also shows the inward surface 122 of the second portion 120, and the inward surface 112 of the first portion 110. Each of the outward surfaces 111, 121, 131 can have a generally smooth shape to restrict or prevent the clip 102 from snagging clothing that is placed over the garment to which the clip 102 is attached, and/or to prevent irritation when the garment is placed directly against the wearer's skin. Each of the inward surfaces 112, 122, 132 can include friction features 103 that aid in keeping the clip 102 in position once installed on a garment.

Figure 3:
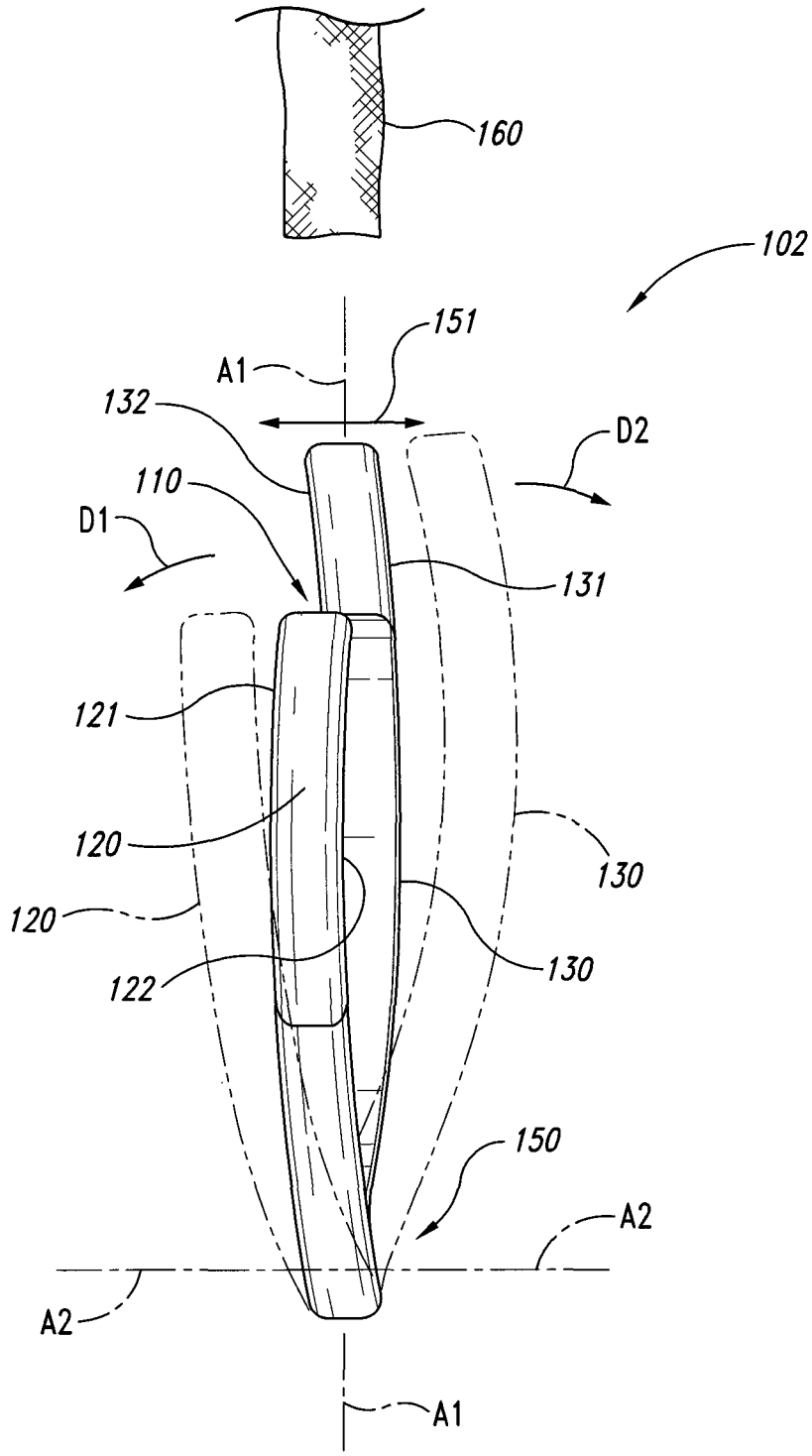
FIG. 3 is a partially schematic, right side view of an embodiment of the tag shown in FIG. 1.

FIG. 3 is a side elevation view of an embodiment of the clip 102 described above with reference to FIGS. 1 and 2, illustrating further aspects of the clip 102, and also illustrating a representative method for operating the clip 102. As shown in FIG. 3, each of the three portions 110, 120, and 130 of the clip 102 extend away from the attachment region 150 along or parallel to a first axis A1. Each of the three portions 110, 120, and 130 may be movable relative to each other along or parallel to a second axis A2 that is generally transverse (e.g., perpendicular) to the first axis A1. Accordingly, the second portion 120 can be moved away from the third portion 130 as indicated by arrow D1, as can the first portion 110, which is hidden behind the second portion 120 in the view shown in FIG. 3. Similarly, the third portion 130 can be moved away from the first and second portions 110, 120 as indicated by arrow D2. The second and third portions 120, 130 are shown in solid lines in an undeployed or neutral position, and in dashed lines when moved from the neutral position. Once the third portion 130 is moved away from the first and second portions 110, 120 (and/or the first and second portions 110, 120 are moved apart from the third portion 130), a gap 151 is opened between the first and second portions 110, 120 on the one hand, and the third portion 130 on the other. The gap 151 can be wide enough to accommodate a piece of fabric or other material forming the garment 160 to which the clip 102 is attached. The clip 102 can be attached by moving it upwardly relative to a downward facing edge of the garment 160, or the clip 102 can be installed by moving it downwardly relative to an upward facing edge of the garment 160. In either case, the friction features 103 (FIGS. 1 and 2) of the inward surfaces 122, 132 can aid in keeping the clip 102 in position on the garment 160 once installed. Accordingly, the friction features 103 can include dimples or stipples having a circular or other cross-sectional shape, or the friction features 103 can include recesses, protrusions, ridges, roughness elements, and/or other suitable structures.

As shown in FIG. 3, the first, second and third portions 110, 120, 130 can be resiliently flexible and can tend to return to the neutral position shown in solid lines in FIG. 3. Accordingly, when the portions are moved relative to each other, as indicated in dashed lines in FIG. 3, the resilient restoring force can aid in clamping the clip 102 to the garment 160. The first and second portions 110, 120 can have a convex shape when viewed from the front (the left side of FIG. 3) and the third portion 130 can have a concave shape when viewed from the same direction. Accordingly, the portions 110, 120, 130 together can form a clam shell-type shape. One advantage of this feature is that it can keep the free edges of each of the portions 110, 120, 130 tending to an inward direction so as to keep them from flaring outwardly, which might cause them to snag on the wearer's skin or an overlying garment.

In a particular aspect of an embodiment described above with reference to FIGS. 1-3, multiple clips 102 form the overall system 100, and can be both linked and distinguished via a characteristic attribute. For example, one clip 102 can have a green color, another clip 102 can have a yellow color, and a third clip 102 can have a red color. In a particular embodiment, the user can install the green clip before the garment 160 is first worn, or after the garment 160 has been cleaned. After the garment 160 has been worn once, the user can replace the green clip 102 with a yellow clip 102, and after the garment 160 has been worn twice, the user can replace the yellow clip 120 with a red clip 120. After the garment 160 has been worn three times, the user can designate the garment 160 for washing. In a particular embodiment, the red clip 102 can then be removed before the garment 160 is washed; in other embodiments, the red clip 102 can be cleaned along with the garment 160. In other embodiments, the clips 102 can have other colors. In one embodiment, the clips can have varying shades of a single color, e.g., varying shades of gray. In any of these embodiments, when the clip 102 is used for undergarments, the colors can be sufficiently visible and distinguishable to the user when the garment is not worn so as to permit easy use, yet subtle enough so as not to be readily visible through overlying clothing, including gauzy or other translucent fabrics. In one embodiment, the clip can have a color similar to the color of the garment it is attached to so as to further ensure that the clip is not visible through overlying clothing. For example, clips of varying shades of gray can be used with a black garment and clips of varying shades of beige can be used with a neutral-colored garment. The entire clip 102 can have one of the designated colors, or only a portion of the clip can have the designated color. In any of these embodiments, the characteristic attribute (e.g., the color) can have different values (e.g., green, yellow or red, or light, medium or dark) and can be fixedly integrated with the clip (e.g., via an appropriately selected dye, glitter, paint or other coloring that is applied to the surface of the clip and/or distributed throughout the material making up the clip) so as to remain a part of the clip through multiple uses.

In other embodiments, the clips 102 or other elements that form the system 100 can be used in other manners. For example, the user may wish to have clips 102 with more than three colors for garments 160 that can readily be worn more times between cleanings. Alternatively, the user can use clips 102 with fewer colors for garments 160 that the user wishes to clean more frequently. In another embodiment, the garment 160 can be worn (e.g., once) before the initial clip is placed on it.

One feature of several of the embodiments described above is that the clip 102 can have a small size and a fairly simple mechanical construction. For example, the clip can have a diameter of from about 0.7 inches to about 0.9 inches in particular embodiments, so as to be easily visible and manipulable when the garment is not being worn, and undetectable when the garment is being worn. This relatively small size (e.g., small diameter and small thickness) reduces the amount of material required to manufacture the clip 102, and accordingly reduces the manufacturing cost. The clip 102 can be molded (e.g., injection molded) or otherwise formed from a plastic (e.g., acetal plastic) or other suitable material, in pearlized or other colors. Accordingly, the clip 102 can be inexpensive to manufacture and yet rugged enough to withstand many uses. This is unlike some existing arrangements which have more complex systems of dials and other structures for tracking garment usage.

Another feature of at least some of the foregoing embodiments is that the clips 102 can be easy to use. In particular, the user need only remove one clip and replace it with another clip of a different color (or other attribute) when performing the steps described above. This is unlike some existing systems which require the user to manually record information on a paper tag.

Still another feature of at least some of the foregoing embodiments is that the user can retain control over the tracking function, rather than having the function performed automatically. For example, if the garment is tried on briefly, the system does not automatically record another use, as would some existing systems. As a result, the user has the flexibility to distinguish a wearing event that is of sufficient duration to be tracked, from one that is not.

Another feature of at least some of the foregoing embodiments is that the clips may be used repeatedly over a large number of cycles. Accordingly, the user need not purchase new clips prior to each washing, or retain an unnecessarily large number of clips relative to the number of garments on which the clips are used.

From the foregoing, it will be appreciated that specific embodiments of the disclosure have been described herein for purposes of illustration, but that various modifications may be made without deviating from the disclosure. For example, the clip illustrated in FIGS. 1-3 has an overall daisy shape, but can have other shapes in other embodiments. The clip shown in FIGS. 1-3 has three portions that are moveable relative to each other in a particular embodiment, and can have other numbers of portions (e.g., two, four, or more) in other embodiments. For example, the clip can have a split ring configuration, or a flat spiral configuration.

The tag 101 described above can have a clip configuration, but can have other attachment arrangements in other embodiments. Such arrangements can include buttons, hook-and-loop attachments, snaps, and/or other suitable structures. In a particular embodiment described above, a "stop light" color scheme is used to distinguish one tag from another. In other embodiments, any of a variety of suitable indicators can be used, including colors other than green, yellow and red (e.g., shades of gray, or light pastel colors), numbers, letters, Braille, icons (e.g., a smiling face, a neutral face, and a frowning face) or shapes (e.g., a circle, a triangle, and a square). In a particular embodiment, the tags can be used many times, and can be configured to withstand detergents, dryer heat, body secretions, dirt, and other exposures associated with multiple uses. In still further embodiments however, the clip or other tag can be disposable. In still further embodiments, the manual operation of the tags can be replaced and/or facilitated with an automatic or partially automatic arrangement. For example, a reactive material (e.g., a nanotechnology material) that automatically changes characteristics based on soil level, microbial content, exposure to sweat, and/or other environmental factors can be used to automatically indicate the need for cleaning.

An individual clip 102 can have one color (e.g., red) on one side, and a different color (e.g., green) on the other side. A system of such clips can be used to track up to two wearings between washings. In another embodiment, such clips can be used with other clips having two different colors (e.g., light yellow and orange) to track up to four wearings between washings. In still another embodiment, the clip 102 can have three sides or three other states to track three wearings between washings.

The tags described above can be colorfast, so that any coloring on the tag will not be transferred to the wearer's skin or clothing during use, or to the bra or other clothing during washing. The tags can be made of a hypo-allergenic material that will not cause skin irritation.

The tags can have other uses in addition to or in lieu of tracking the number of times a garment has been worn. For example, the tags can be used to mark differently-sized articles of clothing within a closet so that the user can quickly identify articles of the desired size. For instance, all medium-sized articles of clothing can be marked with a tag of one color, and all large-sized articles of clothing can be marked with a tag of a second color. Similarly, the tags can be used to distinguish between articles belonging to different users who share a closet, or between a woman's maternity and non-maternity clothing. These methods of use can include attaching the tags to either the articles of clothing in one embodiment or to the hangers supporting the articles in another embodiment.

The tags can be used to mark seasonal wear so that a user can quickly find weather-appropriate clothing choices within his or her wardrobe. For example, all summer clothing items can be marked with a tag of a certain color, so the user can efficiently find clothing items suitable for wearing in warm weather. Again, the tags can be attached either to the articles of clothing in one embodiment, or to the hangers supporting the articles in another embodiment.

The tags can be used to determine when it is appropriate to remove an article of clothing from a wardrobe for lack of use. This can be done by marking all articles of clothing or their corresponding hangers with a tag after use. Items that have not been worn after a certain amount of time (e.g. a season or year), can be identified because they are not tagged. The untagged items can then be removed from the wardrobe. Alternatively, all articles of clothing in a wardrobe can be marked with a tag and the user can remove the tag upon wearing the article. Articles still having tags at the end a certain time period are thus designated for removal from the wardrobe.

The tags can be used by a breastfeeding mother to mark sides of her bra corresponding to which breast has been or needs to be pumped or given to her baby. For example, if a mother nurses with her left breast, she can tag the right side of her bra to remind herself to use her right breast for her next nursing or pumping session. Alternatively, the mother may choose to tag the side of the bra corresponding to the breast from which she just nursed or pumped so that she will remember to use the breast corresponding to the unmarked side of her bra during the following nursing or pumping session. In another embodiment, the mother may choose to use two tags with different characteristic attributes. For example, after pumping or nursing from her right breast, she may put a red tag on the right side of her bra and a green tag on the left side of her bra. Tags with different colors or other characteristic attributes may be used.

Certain aspects of the embodiments described above may be combined or eliminated in other embodiments. For example, the friction features described above may be eliminated in cases for which the inherent forces provided by the resilience of the clip portions obviate the need for such friction features. Further, while advantages associated with certain embodiments have been described in the context of those embodiments, other embodiments may also exhibit such advantages. Not all embodiments need necessarily exhibit such advantages to fall within the scope of the present disclosure. Accordingly, the disclosure and associated technology can encompass other embodiments not expressly shown or described herein.

The invention claimed is:

1. A method for tracking bra usage, comprising:

selecting a bra;

removably attaching a first daisy-shaped clip to the bra, the first daisy-shaped clip having a green color;

after the bra is worn a first time, removing the first daisy-shaped clip and removably attaching a second daisy-shaped clip to the bra, the second daisy-shaped clip having a yellow color;

after the bra is worn a second time, removing the second daisy-shaped clip and removably attaching a third daisy-shaped clip to the bra, the third daisy-shaped clip having a red color; and after wearing the bra a third time, removing the third daisy-shaped clip and washing the bra.

2. The method of claim 1, further comprising washing the bra prior to removably attaching the first daisy-shaped clip to the bra.

3. A method for tracking clothing usage, comprising:

selecting an item of clothing;

before or after the item of clothing is worn a first time, removably attaching a first tag to the item of clothing, the first tag having a first fixedly integrated identifier having a characteristic attribute with a first value;

after the item of clothing is worn at least one time with the first tag, removing the first tag and removably attaching a second tag to the item of clothing, the second tag having a second fixedly integrated identifier having second value of the characteristic attribute that is different than the first value;

after the item of clothing is worn at least one time with the second tag, designating the item of clothing for cleaning; and removing the second tag.

4. The method of claim 3, further comprising cleaning the item of clothing, and wherein removing the second tag is completed before cleaning the item of clothing.

5. The method of claim 3, further comprising after cleaning the item of clothing, removably attaching the same first tag or another generally identical first tag to the item of clothing before the item of clothing is worn again.

6. The method of claim 3, wherein selecting an item of clothing includes selecting a bra.

7. The method of claim 3, wherein removably attaching a first tag includes removably attaching a first tag having color as the characteristic attribute.

8. The method of claim 3, further comprising cleaning the item of clothing, and wherein cleaning the item of clothing includes cleaning the second tag.

9. The method of claim 3, wherein removably attaching the first tag includes removably attaching the first tag to the item of clothing after the item of clothing is worn the first time.

10. The method of claim 3, wherein removably attaching the first tag includes removably attaching the first tag to the item of clothing before the item of clothing is worn the first time.

11. The method of claim 3, further comprising:

after the item of clothing is worn at least one time with the second tag, removing the second tag and removably attaching a third tag to the item of clothing, the third tag having a third fixedly integrated identifier having a third value of the characteristic attribute that is different than the first value and the second value, and after the item of clothing is worn at least one time with the third tag, designating the item of clothing for cleaning.

* * * * *